US011511921B1

(12) United States Patent
Wikstrom et al.

(10) Patent No.: US 11,511,921 B1
(45) Date of Patent: Nov. 29, 2022

(54) TAMPER-EVIDENT CONTAINER LOCK

(71) Applicants: Todd Wikstrom, Las Vegas, NV (US); Michael Patterson, Middlesex, NJ (US); Bradley Huskinson, Seattle, WA (US); Kevin Prince, Las Vegas, NV (US)

(72) Inventors: Todd Wikstrom, Las Vegas, NV (US); Michael Patterson, Middlesex, NJ (US); Bradley Huskinson, Seattle, WA (US); Kevin Prince, Las Vegas, NV (US)

( * ) Notice: Subject to any disclaimer, the term of this patent is extended or adjusted under 35 U.S.C. 154(b) by 211 days.

(21) Appl. No.: 16/933,173

(22) Filed: Jul. 20, 2020

Related U.S. Application Data

(60) Provisional application No. 62/899,970, filed on Sep. 13, 2019, provisional application No. 62/876,496, filed on Jul. 19, 2019.

(51) Int. Cl.
*B65D 55/02* (2006.01)
*B65D 55/10* (2006.01)
*B65D 55/16* (2006.01)

(52) U.S. Cl.
CPC ..... *B65D 55/024* (2013.01); *B65D 55/10* (2013.01); *B65D 55/165* (2013.01);
(Continued)

(58) Field of Classification Search
CPC .... B65D 55/024; B65D 55/10; B65D 55/165; B65D 2401/00; B65D 2255/00;
(Continued)

(56) References Cited

U.S. PATENT DOCUMENTS 3,786,983 A * 1/1974 Hennessey ..... B65D 5/546 229/152
4,363,403 A * 12/1982 Raucci, Jr. ..... E05B 73/0023 206/387.13

(Continued)

FOREIGN PATENT DOCUMENTS

DE 9405060 U1 * 5/1994 ..... B65D 43/0225
GB 2081228 A * 2/1982 ..... B65D 55/02
WO WO-2011022796 A2 * 3/2011 ..... B65D 47/0804

*Primary Examiner* — J. Gregory Pickett
*Assistant Examiner* — Abigail Elizabeth Guidry
(74) *Attorney, Agent, or Firm* — QuickPatents, LLC; Kevin Prince

(57) ABSTRACT

A lock for a food container of the type having a lower front flap and a partially-overlapping upper front flap, comprises an elongated body that has a tapered front end, a rear end, and a transverse stop disposed between the front end and the rear end. The front end of the elongated body has at least one angled resilient flange that has have a distal end adapted to flex towards the body temporarily in a compressed position when under force. Thereafter the at least one flange springs back to a natural position once inserted through front flap apertures of the container, inhibiting the removal thereof without breaking a perforated section or an otherwise frangible section of the container, thereby leaving evidence that the container has been opened. An embodiment that includes a clasp for receiving the front end of the body with a bag therebetween is also disclosed.

11 Claims, 8 Drawing Sheets

(52) U.S. Cl.
CPC ..... *B65D 2255/00* (2013.01); *B65D 2401/00* (2020.05); *B65D 2543/0049* (2013.01)

(58) Field of Classification Search
CPC ..... B65D 2543/0049; B65D 2401/15; B65D 2543/00296; B65D 17/4011; B65D 17/402; B65D 17/404; B65D 2543/00537; B65D 2401/40; B65D 5/54; B65D 5/643; B65D 5/6611
See application file for complete search history.

(56) References Cited

U.S. PATENT DOCUMENTS 5,211,722 A * 5/1993 Wagner ..... A01G 20/30 47/1.01 R
5,238,134 A * 8/1993 Knapp ..... B65D 43/0274 215/253
5,893,475 A * 4/1999 May ..... B65D 55/06 215/253
5,971,262 A * 10/1999 Moore ..... B65D 5/4295 229/102
6,328,355 B1 * 12/2001 Bortz ..... G09F 3/0323 292/307 R
6,398,028 B1 * 6/2002 Stovall ..... B65H 37/002 206/390
6,814,225 B2 * 11/2004 Belden, Jr. ..... E05B 73/0023 220/326
8,025,207 B1 * 9/2011 Correll ..... B65D 5/2057 229/110
9,399,536 B2 * 7/2016 Bertone ..... B65D 5/069
10,266,302 B1 * 4/2019 Duarte ..... B65D 5/30
D914,495 S * 3/2021 Wikstrom ..... D9/432
2004/0222278 A1 * 11/2004 Correll ..... B65D 5/6664 229/152
2006/0090671 A1 * 5/2006 Ekkert ..... B65D 47/0847 106/439
2007/0246397 A1 * 10/2007 Herzog ..... A45C 11/10 206/560
2009/0188214 A1 * 7/2009 Vohnout-Marle ..... G07D 11/12 220/666
2015/0034645 A1 * 2/2015 Schick ..... B65D 55/024 220/265
2015/0266632 A1 * 9/2015 Kieffer ..... B65D 47/0838 220/268
2017/0297802 A1 * 10/2017 Davis ..... B65D 43/16
2018/0099775 A1 * 4/2018 van Waarden ..... B65D 43/162
2019/0112110 A1 * 4/2019 Taylor ..... B65D 43/162
2019/0375536 A1 * 12/2019 Straszewski ..... B65D 5/46072
2021/0354874 A1 * 11/2021 Konrad ..... B65D 5/42
2021/0371153 A1 * 12/2021 Borst, Sr. ..... B65D 5/6664
2022/0017263 A1 * 1/2022 Wikstrom ..... B65D 5/103
2022/0055794 A1 * 2/2022 Humberstone ..... B65D 5/22
2022/0153510 A1 * 5/2022 Bressan ..... B65D 85/36

* cited by examiner

TAMPER-EVIDENT CONTAINER LOCK

CROSS-REFERENCE TO RELATED APPLICATIONS

This application claims the benefit of U.S. Provisional Patent Application 62/899,970, filed on Sep. 13, 2019, and U.S. Provisional Patent Application 62/876,496, filed on Jul. 19, 2019, both incorporated herein by reference.

DEVELOPMENT

Not Applicable.

FIELD OF THE INVENTION

This invention relates to food containers, and more particularly to a tamper-evident lock for food containers.

BACKGROUND

Pizza delivery, and food delivery in general, has become widely popular not only in the United States, but also globally in industrialized nations. The convenience of a pizza or other meal being delivered at home or at an office, however, is offset by the risks of releasing a food delivery to a delivery person, and thereby losing chain of custody. When the consumer receives his pizza, currently there is no easy way of determining if the pizza was tasted, picked at, or touched by the delivery person, whether or not the delivery person is an employee of the food supplier or not. With the advent of third-party delivery services such as Uber Eats, Grubhub, and the like, there is an even greater need to seal food containers in a tamper-evident manner so that the consumer can easily determine if his food has been tampered with.

Simply taping the food container shut with adhesive tape is ineffective since hot containers often allow the tape adhesive to be easily released, particularly if steam is generated by hot food items within the container. Further, tape may be misapplied or ill-applied by a restaurant worker moving too quickly, as there is no guarantee that the tape has stuck properly to the container other than by attempting to open the container manually and continuing to press the tape against the container to ensure the adhesive has properly bonded to the container.

Wrapping food containers in a bag and stapling the bag shut is a solution that can be overcome quickly by deliver people who carry a spare stapler in their delivery vehicle. Heat sealing the bag is time consuming, requires bags that are heat-sealable, and also requires equipment at the restaurant for sealing the bag, all of which make this a costly option.

Therefore, there is a need for a device that allows a pizza box or other food container to be quickly and irreversibly locked. Such a needed invention would allow the user to simply press a lock through front or side flaps of the container to seal the container, and would require the container to be broken in an evident manner to be opened. Such a needed invention would be usable with cardboard or other boxes and bags, and be relatively inexpensive to manufacture, intuitive to use, and provide a visual confirmation that the container is locked. The present invention accomplishes these objectives.

SUMMARY OF THE INVENTION

The present device is a lock for a food container of the type having a lower front flap and an upper front flap that either at least partially-overlaps the lower front flap, that sits behind the lower front flap, that has a tab that can be inserted between two folded-over lower front flaps, or the like. The front flaps each have a front flap apertures that are mutually aligned when the food container is in the closed position. While front flaps of the food container are discussed herein, it should be understood that analogous side flaps of the container could also be used, or any portions of a container that overlap to close the container.

The lock comprises an elongated body that has a tapered front end, a rear end, and a transverse stop disposed between the front end and the rear end. The front end of the elongated body has at least one, and preferably two, angled resilient flanges that each have a distal end adapted to flex towards the body temporarily in a compressed position when under force. Thereafter each flange springs back to a natural position when the force is removed from pressing the flanges inward toward the elongated body. The lock is of a consistent cross section from top to bottom, allowing the lock to be manufactured utilizing inexpensive plastic extrusion manufacturing techniques.

In use, when the tapered front end is forced through the front flap apertures of the container when the container is closed, the at least one resilient flange flexes to fit through the front flap apertures, thereafter springing back to the natural position such that when the body is pulled away from the container back towards the front flap apertures, the distal end of the at least one flange contacts the front flap or to inhibit the removal thereof from the container. As such the only way to open the box is to break a perforated section or an otherwise frangible section of the container, thereby leaving evidence that the container has been opened.

In preferred embodiments the rear end of the elongated body includes a grip-facilitating structure, such as a bulbous end, parallel grooves, or the like. Further, preferably the transverse stop includes one or two transverse legs projecting away from the elongated body, preferably at a right angle thereto.

In one embodiment further including a clasp, a flexible container such as a bag may be closed between the elongated body and the clasp. A slit or aperture in the bag proximate a top opening thereof receives the elongated body, and once the clasp is fastened around the front end of the body the clasp is impossible to easily remove without tearing the bag and leaving evidence that the bag has been opened.

The present invention is a device that allows a pizza box or other food container to be quickly and irreversibly locked. The present invention allows the user to simply press a lock through front flaps of the container to seal the container, and require the container to be broken in an evident manner in order to be opened. The present device is relatively inexpensive to manufacture, intuitive to use, and provide a visual confirmation that the container is locked. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1A:
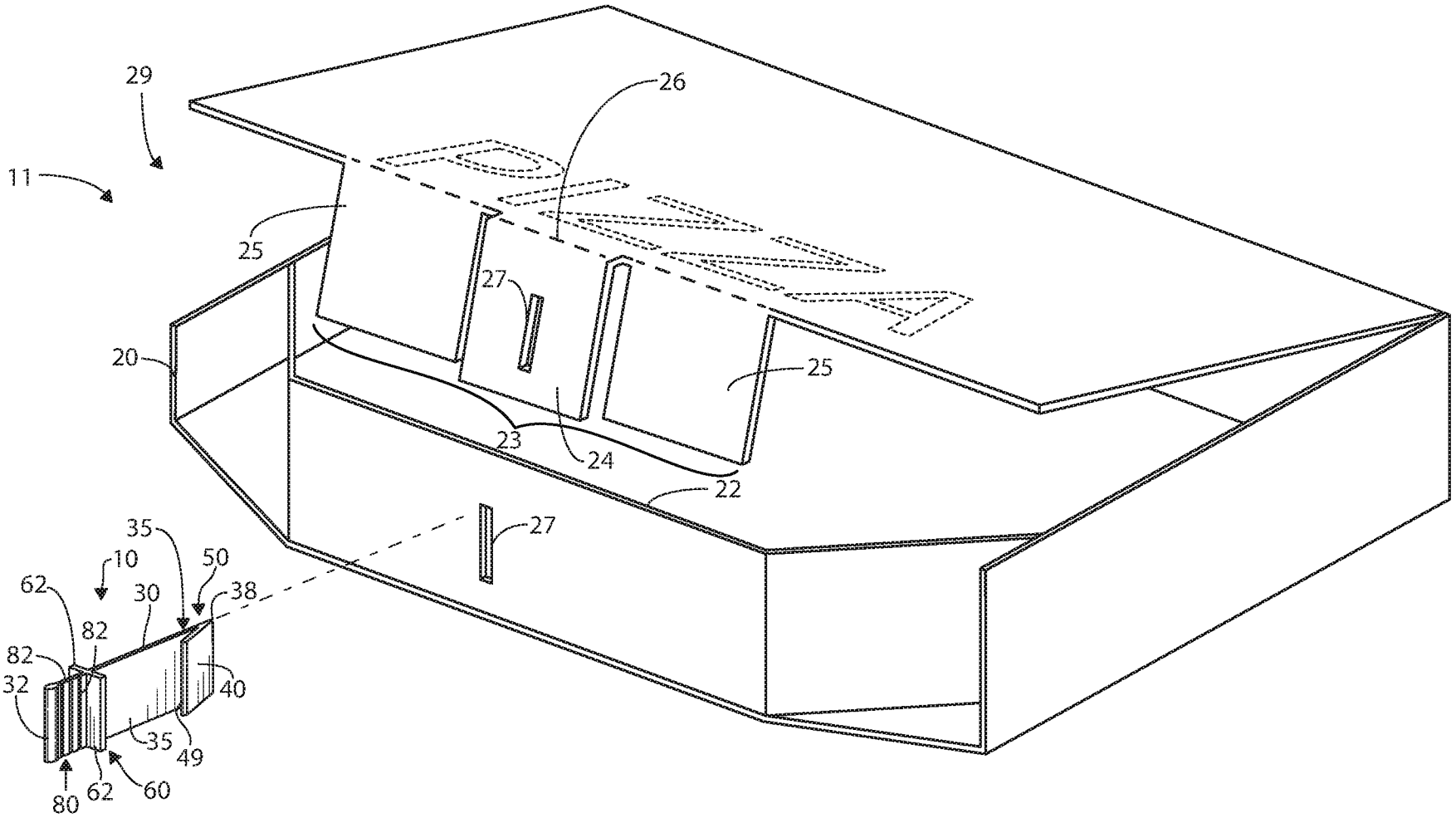
FIG. 1A is a perspective view of a food container in an open position before engaging the lock of the invention.
Figure 1B:
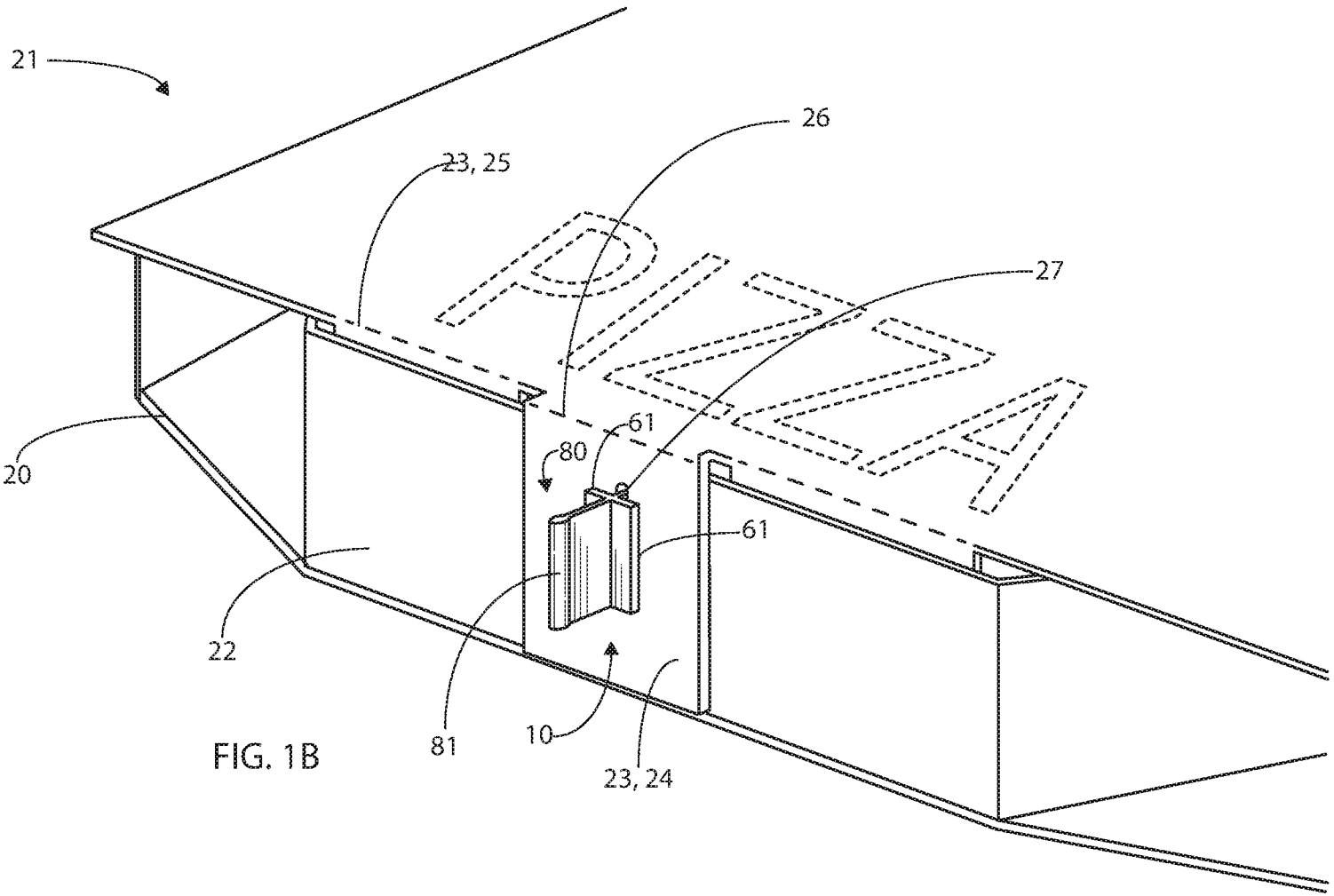
FIG. 1B is a perspective view of FIG. 1 but shown after engaging the lock of the invention.

FIGS. 1A and 1B illustrate a lock 10 for a food container 20 of the type having a lower front flap 22 and an upper front flap 23, the upper front flap 23 adapted to at least partially overlap the lower front flap 22 when the food container 20 is in a closed position 21. Herein the words lock, fastener, and closure represent the lock 10. The front flaps 22,23 each have a front flap apertures 27 that are mutually aligned when the food container 20 is in the closed position 21. Preferably the food container 20 is of the type having a perforated section 26 whereby when locked with the lock 10 the food container 20 can be opened only in such a way that provides evidence that the food container 20 has been opened into an open position 29.

Such a food container 20 may be a pizza box as illustrated, a Chinese food container (not shown), or other container 20 where it is desirable to determine if the container 20 has been opened surreptitiously during delivery, for example. Most containers 20 that require to portions of the container 20 to overlap for closure of the container 20 can be used with the present invention. In some embodiments the container 20 is included with the lock 10 as a system for securing a food item, such as pizza (not shown), during transport or storage, typically between cooking of the food item and delivery of the food item. As such, the lock 10 on an existing container 20, or the system that includes both the lock 10 and the container 20, each provide a lock 10 for the container 20 that is tamper-evident.

Figure 3:
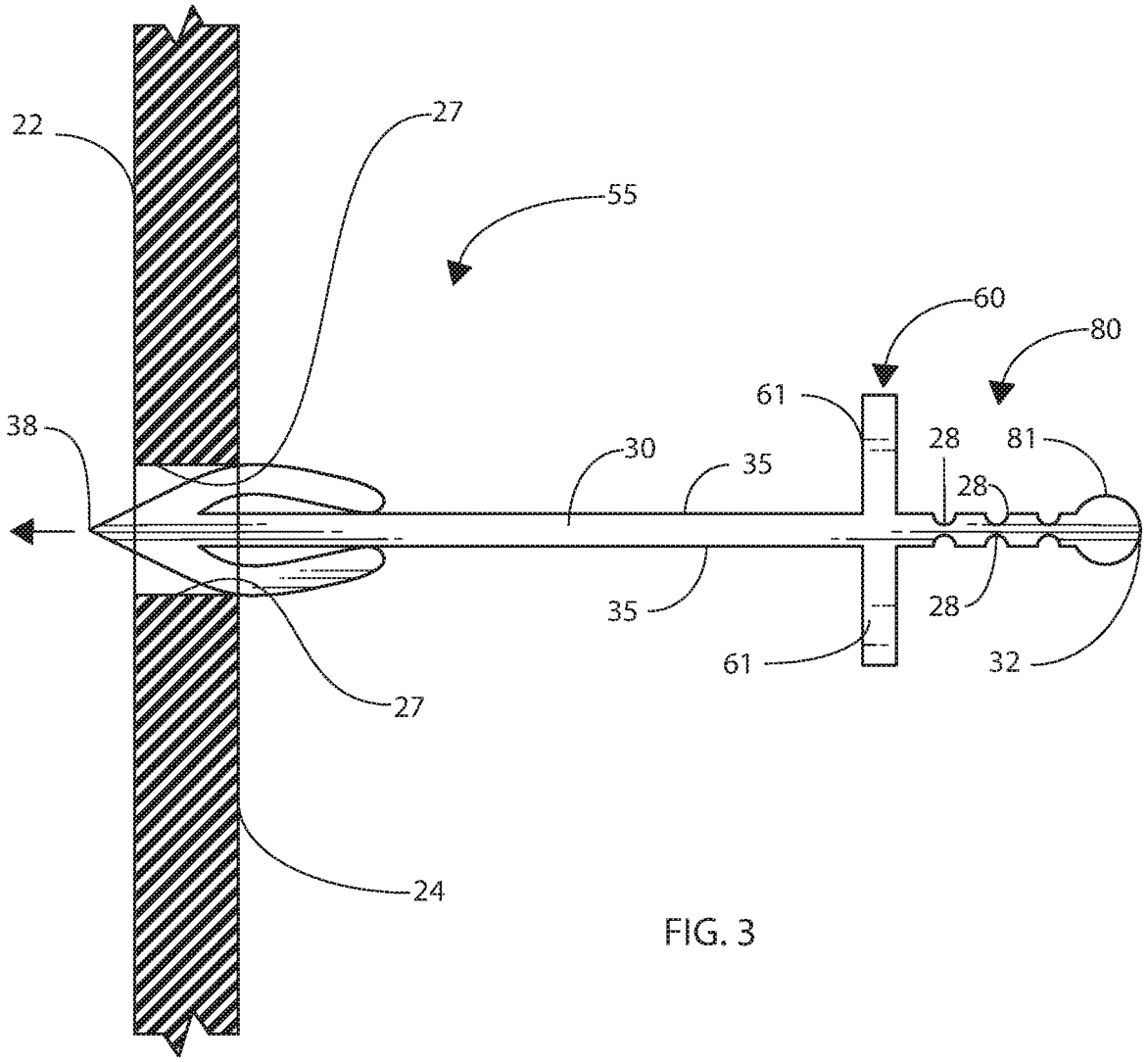
FIG. 3 is a top plan view of one embodiment of the invention, illustrated as traversing front flap apertures of a lower front flap and an upper front flap of a food container.

The lock 10 comprises an elongated body 30 that has a tapered front end 38, a rear end 32, and a transverse stop 60 disposed between the front end 38 and the rear end 32 (FIG. 3). Preferably the lock 10 is made from a semi-rigid or resilient plastic material, and can be made long enough, such as 1.5-inches, to not be considered a choking hazard for children under three years old by the American Academy of Pediatrics or other policy or advisory groups. The length of the body 30 can be adjusted in a central zone 33 (FIG. 4) to accomplish any desired and effective length of the body 30.

Figure 2:
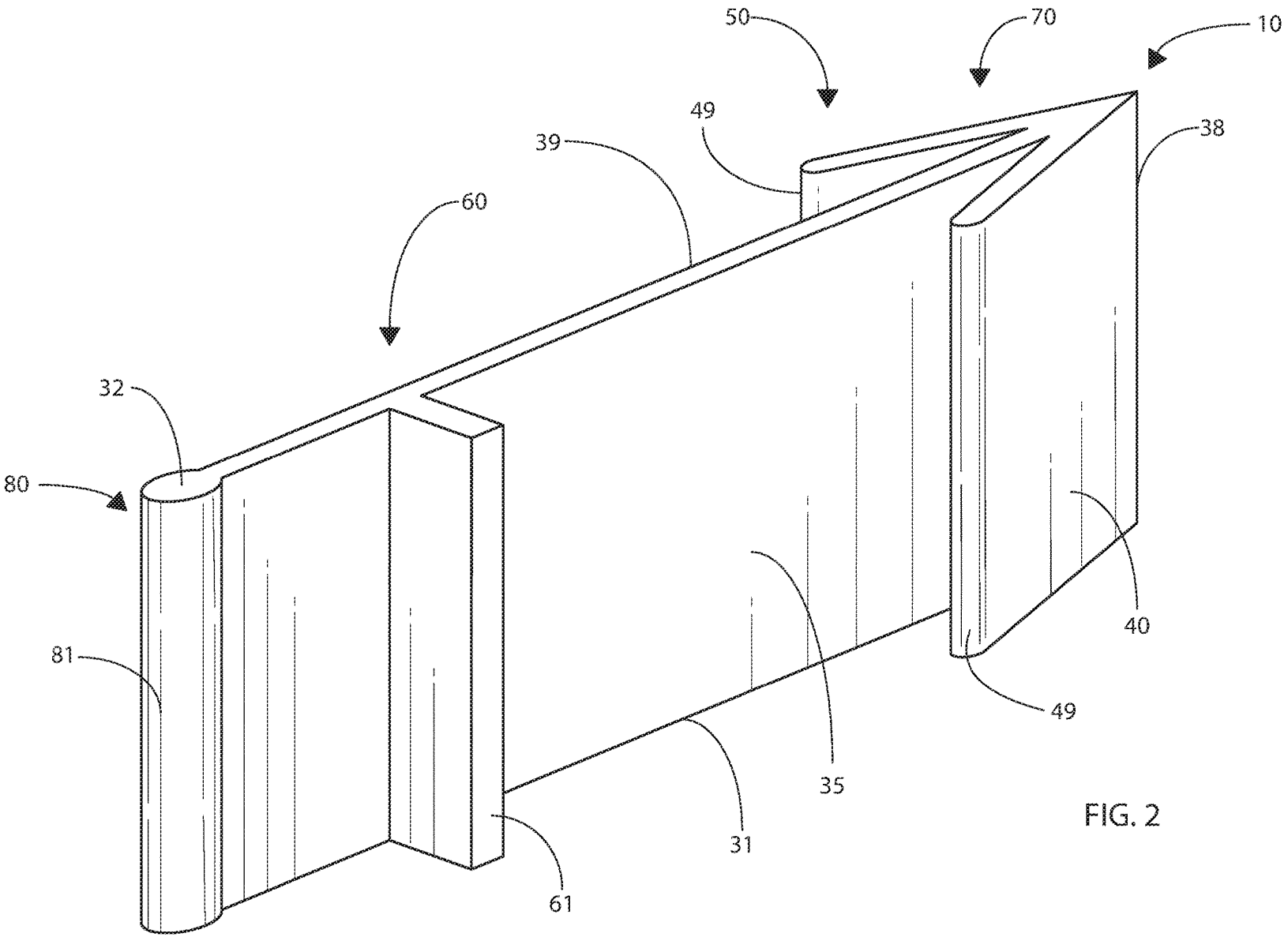
FIG. 2 is an enlarged perspective view of the lock of the invention.

The front end 38 of the elongated body 30 has at least one, and preferably two, angled resilient flanges 40 that each have a distal end 49 adapted to flex towards the body 30 temporarily in a compressed position 55 (FIG. 3) when under force. Thereafter each flange 40 springs back to a natural position 50 (FIG. 2) when the force is removed from pressing the flanges 40 inward toward the elongated body 30. In embodiments having two of the resilient flanges 40, preferably each resilient flange 40 is on an opposing side 35 of the elongated body to form an arrow shape 70 (FIG. 2).

As such, when the tapered front end 38 is forced through the front flap apertures 27 of the container 20 when the container is closed, the at least one resilient flange 40 flexes to fit through the front flap apertures 27 (FIG. 3), thereafter springing back to the natural position 50 such that when the body 30 is pulled away from the container 20 back towards the front flap apertures 27, the distal end 49 of the at least one flange 40 contacts the front flap 22 or 23 to inhibit the removal thereof from the container 20. As such the only way to open the box is to break the perforated section 26 (FIG. 1A) or an otherwise frangible section of the container 20, thereby leaving evidence that the container 20 has been opened after the elongated body 30 has been inserted into the container 20.

In preferred embodiments the rear end 32 of the elongated body 30 includes a grip-facilitating structure 80, such as a bulbous end 81 (FIGS. 1B-3), parallel grooves 82 (FIG. 1A), or the like. Further, preferably the transverse stop 60 includes one or two transverse legs 62 projecting away from the elongated body 30, preferably at a right angle thereto.

Figure 4:
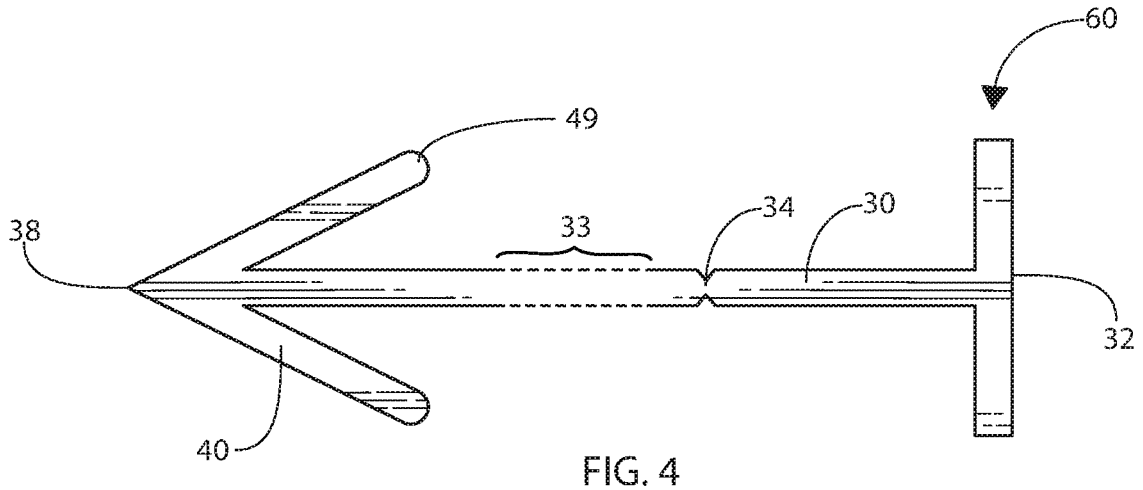
FIG. 4 is a top plan view of an alternate embodiment of the invention.

The elongated body 30, resilient flanges 40, and grip-facilitating structure 80 are all preferably integrally formed from a plastic extrusion process, wherein the lock 10 has a consistent cross-section from a top side 39 thereof to a bottom side 31 thereof. An embodiment of the invention with the grip-facilitating structure 80 omitted is shown in FIG. 4.

Preferably the upper front flap 23 of the container 20 includes a forward section 24 cut away from a remaining sections 25 of the upper front flap 32, the forward section 24 having the front flap aperture 27 (FIG. 1A). The remaining sections 25 of the upper front flap 23 are positionable behind the lower front flap 22 when the container 20 is closed, and the forward section 24 of the upper front flap 23 is positionable in front of the lower front flap 22 when the container is closed. As such the lower front flap 22 reinforces the forward section 24 of the upper front flap 23 when the front end 38 of the elongated body 30 is pushed through the front flap apertures 27 to lock the container 20.

In some embodiments, a perforated punch-out tab 110 (FIG. 5B) may be included and affixed with the forward section 24 of the upper flap 23, such that when the elongated body 30 is engaged with the front flap aperture 27 to lock the container 20 in the closed position 21, to unlock the container 20 a user simply has to depress the punch-out tab downward to release the punch-out tab 110 and the forward section 24 from the container 20. As such, if a user receives a container 20 wherein the punch-out tab 110 is already depressed and separated from the rest of the container 20, the user is then alerted to the fact that the container 20 was not locked or sealed.

Figure 5A:
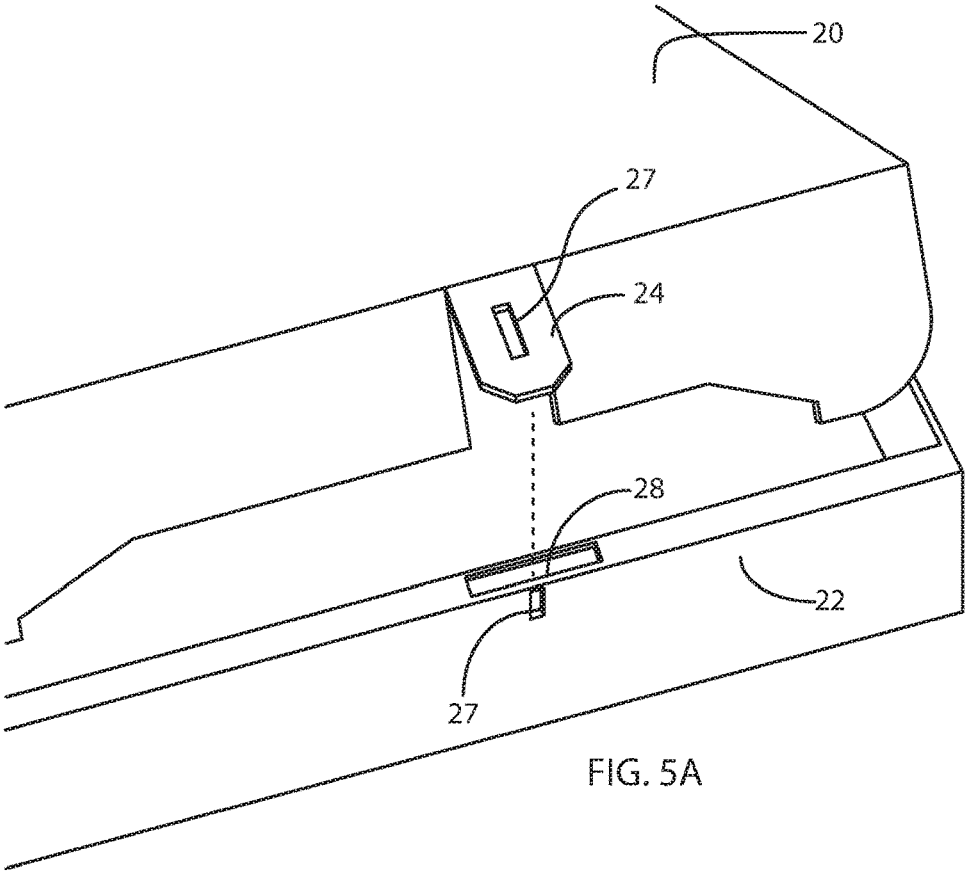
FIG. 5A is a perspective view of an alternate embodiment of the container in a semi-open position.
Figure 5B:
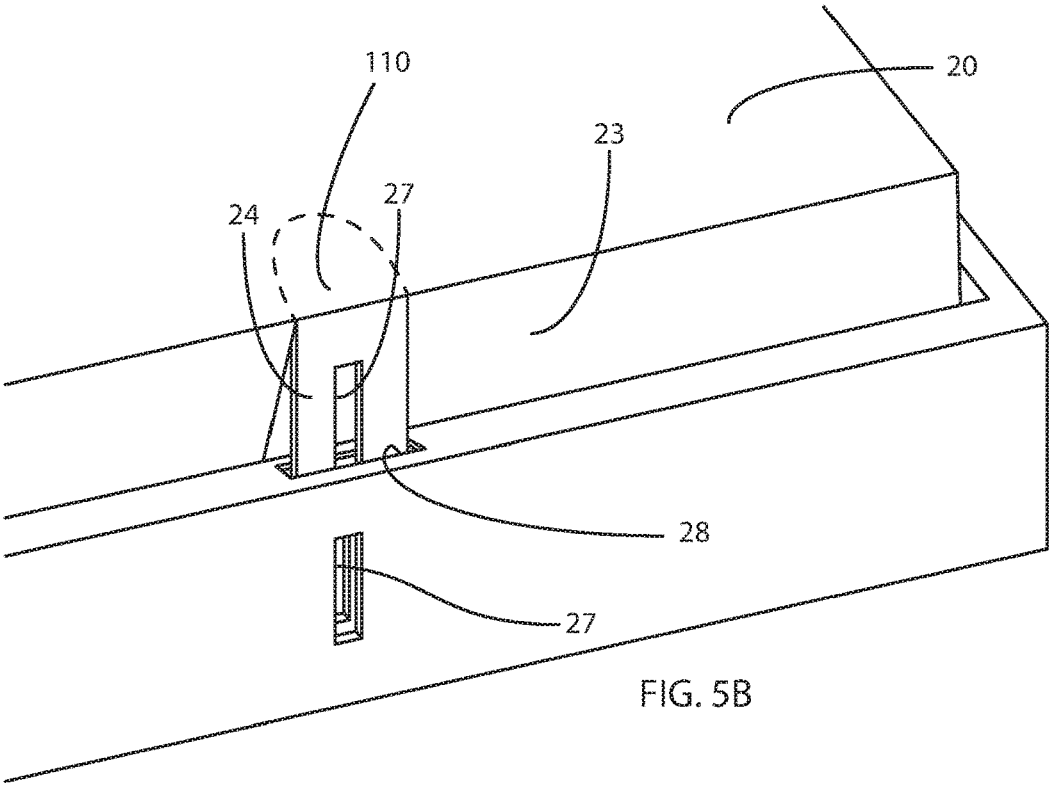
FIG. 5B is a perspective view of the embodiment of FIG. 5A while being closed.
Figure 6:
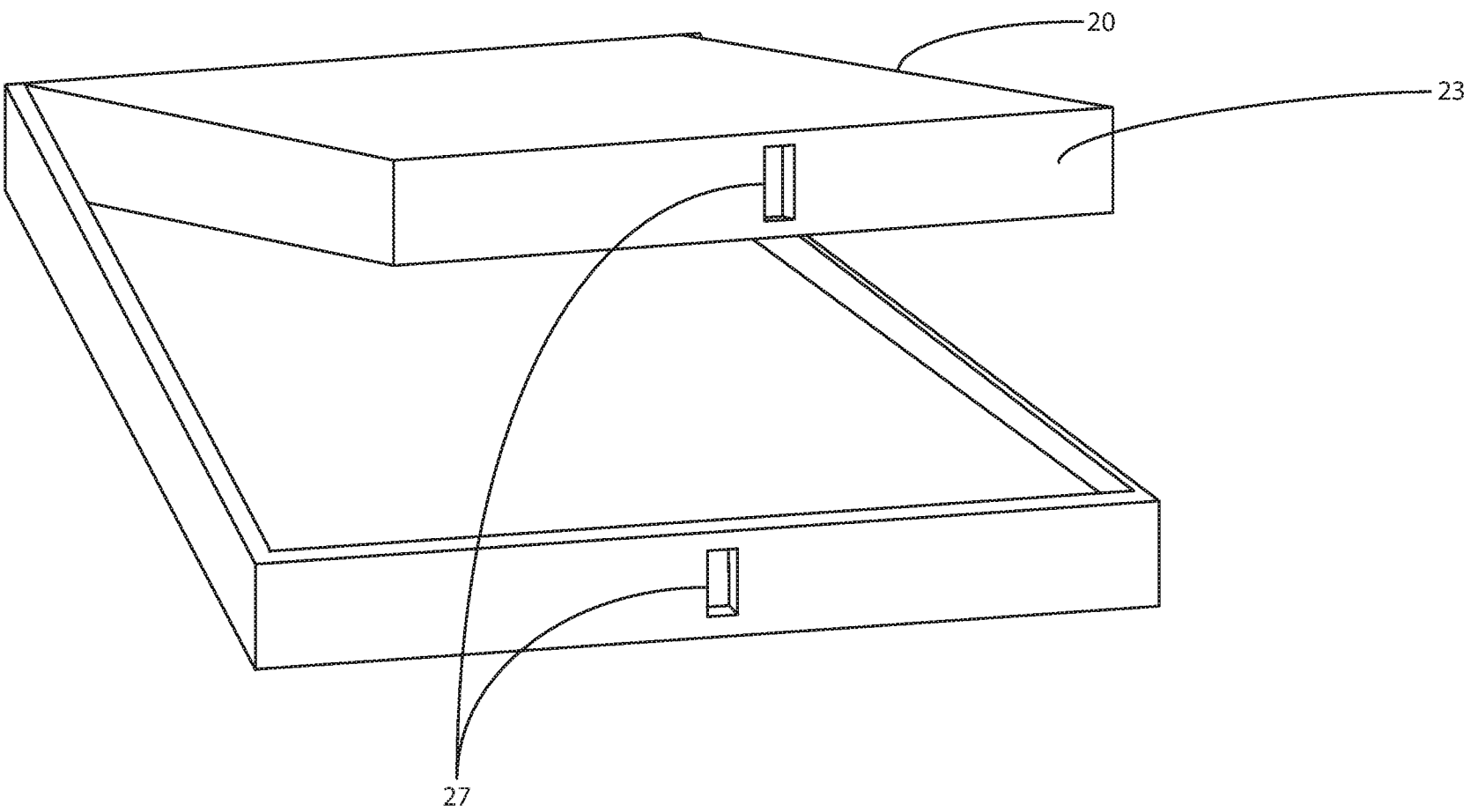
FIG. 6 is a perspective view of another alternate embodiment of the container.
Figure 7:
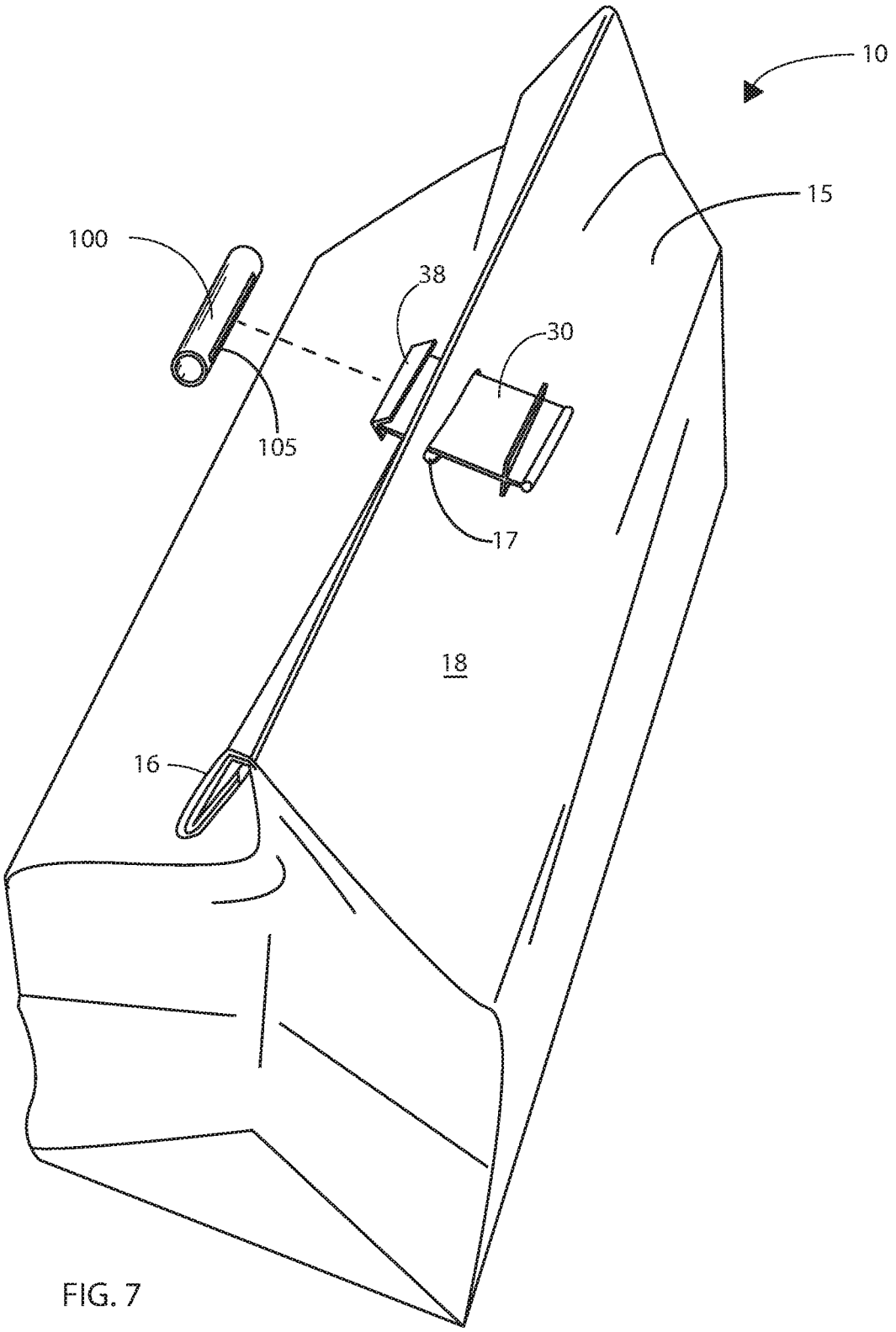
FIG. 7 is a perspective view of an alternate embodiment of the invention that includes a clasp.
Figure 8:
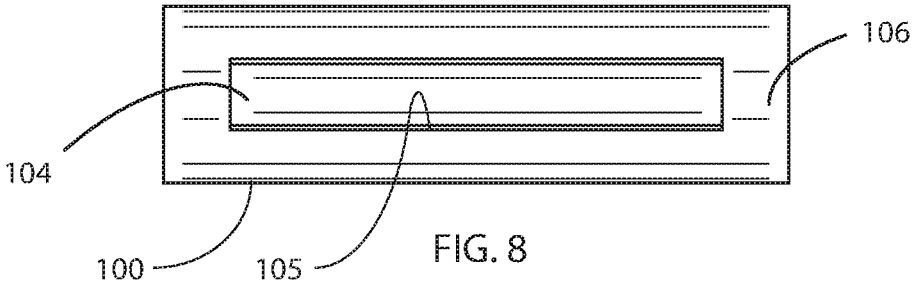
FIG. 8 is a front elevational view of a clasp of the invention.
Figure 9:
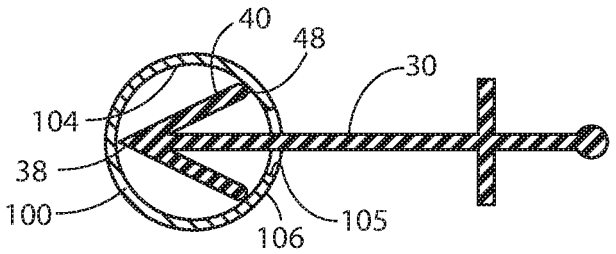
FIG. 9 is a cross-sectional view across a longitudinal axis of the lock and the clasp while mutually engaged.
Figure 10:
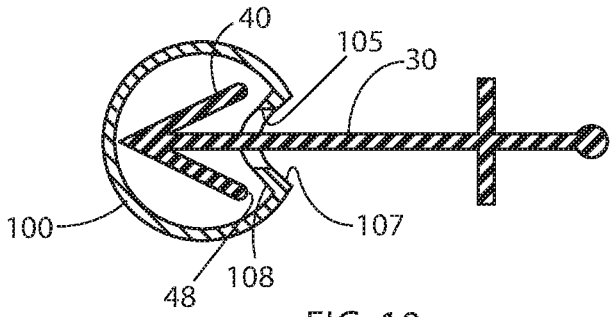
FIG. 10 is a cross-sectional view across a longitudinal axis of the lock and an alternate embodiment of the clasp while mutually engaged.
Figure 11:
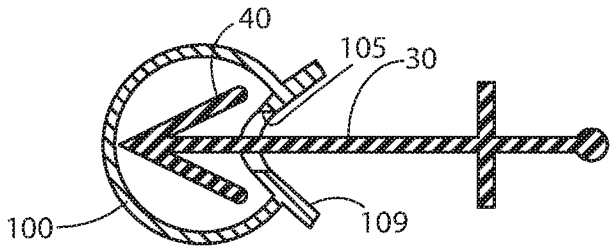
FIG. 11 is a cross-sectional view across a longitudinal axis of the lock and another alternate embodiment of the clasp while mutually engaged.

Alternately the upper front flap 23 may be inserted completely overlapping and either behind or in front of the lower front flap 22 (FIG. 6), or the forward section 24 of the upper front flap 23 may be inserted into a slot 28 of the lower front flap 22 that is folded-over in a double-wall configuration (FIGS. 5A and 5B). Preferably flap apertures 27 are cut completely through the container material during manufacturing, such as by die cutting, so that chads (not shown) are not partially attached to the container 20 that may detach and come to rest on the food item. Alternately, the flap apertures 27 may be an I-shaped slit cut into the flaps 22,23, through which the distal end 38 of the elongated body 30 may be inserted.

In an alternate embodiment of the invention, a frangible portion 34 (FIG. 4) of the elongated body 30 can be broken to open the container 20 without damaging the container 20. Such a frangible portion 34 can be formed during the extrusion of the elongated body 30, or in a plastic injection molding process.

FIGS. 7-11 illustrate an embodiment of the invention wherein the container 20 is a bag 15 of the type that has a flexible web 18 with an open top end 16. An aperture or slit 17 is formed through the flexible web 18 proximate the top end 16 of the bag 15. Typically such a bag is a food delivery bag with the open top end 16 folded down several times. The slit 17 may be formed through the folded-over top end 16 with a knife or paper punch, for example. The bag 15 is typically a paper bag, but can also be a bag formed from vinyl, fabric, or other suitable material.

The lock 10 in such an embodiment further includes an elongated, substantially hollow clasp 100 having an outside surface 106, an inside surface 104, and an elongated aperture 105 aligned longitudinally along the clasp 100 and traversing from the outside surface 106 to the inside surface 104. The elongated aperture 100 is adapted to receive the front end 38 of the elongated body 30 therethrough. When the tapered front end 38 of the body 30 is forced through the slit 17 of the bag 15 and the elongated aperture 105 of the clasp 100, the at least one resilient flange 40 flexes to fit through the slit 17 and the elongated aperture 105, thereafter springing back to the natural position 50 such that when the body 30 is pulled away from the claps 100 back through the elongated aperture 105, the distal end 49 of the at least one flange 40 contacts the inside surface 104 of the clasp 100 to inhibit the removal thereof from the clasp 100 and the bag 15. As such, to open the bag 15 the bag 15 must be torn to release the lock 10 from the bag 15, thereby leaving evidence that the bag 15 has been opened.

The elongated aperture 105 of the clasp 100 may further include internal ramps 107 (FIG. 10) adapted to facilitate the flexing of the at least one resilient flange 40 when the front end 38 of the body 30 passes through the elongated aperture 105. In such an embodiment, each internal ramp 107 may include a flange-catching surface 108 adapted to deflect the at least one resilient flange 40 away from the elongated body 30 of the lock 10 when the elongated body 30 is pulled away from the clasp 100. Further, the elongated aperture 105 of the clasp 100 may further include external ramps 109 (FIG. 11) adapted to facilitate the flexing of the at least one resilient flange 40 when the front end 38 of the elongated body 30 passes through the elongated aperture 105. Such an embodiment reinforces the bag 15 at the slit 17 to inhibit tearing of the bag 15 prematurely. In use, a user positions the bag 15 such that the slit 17 is between the front end 38 of the elongated body and the external ramps 109 or the aperture 105 of the claps 100. Pressing the front end 38 of the body into the clasp 100, the front end 38 of the body 30 passes through the slit 17 and the elongated aperture 105 to snap into place as the resilient flange(s) 40 of the front end 38 of the body 30 pass completely through the elongated aperture 105 of the clasp, thereby locking the clasp 100 to the body 30. As such, it becomes essentially impossible to easily remove the lock 10 from the bag 15 without tearing the bag 15 and leaving evidence of the opening of the bag 15.

While a particular form of the invention has been illustrated and described, it will be apparent that various modifications can be made without departing from the spirit and scope of the invention. For example, containers 20 other than pizza boxes may be utilized, including Chinese food take-out boxes, polystyrene food containers often used for restaurant to-go boxes, and the like. Moreover, while front flaps 22,23 of the food container 20 are discussed herein, it should be understood that analogous side flaps (not shown) of the container could also be used, or any portions of a container that overlap to close the container. The container does not, in fact, have to be purposed for food, but could be used for anything that needs a tamper-evident fastener. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A lock for a food container of the type having a lower front flap, an upper front flap, the upper front flap adapted to at least partially overlap the lower front flap when the food container is closed, the front flaps each having front flap apertures each mutually aligned when the container is closed, the lock comprising:

an elongated body having a tapered front end, rear end, and a transverse stop disposed between the front end and the rear end;

the front end having at least one angled resilient flange having a distal end adapted to flex towards the body temporarily when under force but then to spring back to a natural position when the force is removed;

wherein the rear end of the elongated body includes a grip-facilitating structure in the form of a bulbous end; and wherein the transverse stop comprises at least one transverse leg projecting away from the elongated body;

whereby when the tapered front end is forced through the front flap apertures of the container when the container is closed, the at least one resilient flange flexes to fit through the front flap apertures, thereafter springing back to the natural position such that when the body is pulled away from the container back through the front flap apertures the distal end of the at least one flange contacts the front flap of the container to inhibit the removal thereof from the container.

2. The lock of claim 1 wherein the at least one angled resilient flange is exactly two angled resilient flanges, one on each side of the elongated body, together with the body forming an arrow shape.

3. The lock of claim 1 wherein the elongated body, the at least one resilient flange, and the grip-facilitating structure are integrally formed.

4. The lock of claim 3 wherein the elongated body and the at least one resilient flange have a consistent cross-section from a top side thereof to a bottom side thereof, whereby the elongated body and the at least one resilient flange are formed through an extrusion process, the elongated body further including a frangible point between the tapered front end and the rear end for facilitating selective breaking of the elongated body at the frangible point.

5. A system for securing a food item, comprising:

a food container of the type having a lower front flap, an upper front flap, the upper front flap adapted to at least partially overlap the lower front flap when the food container is closed, the front flaps each having front flap apertures each mutually aligned when the container is closed;

an elongated body having a tapered front end, rear end, and a transverse stop disposed between the front end and the rear end;

the front end having at least one angled resilient flange having a distal end adapted to flex towards the body temporarily when under force but then to spring back to a natural position when the force is removed;

wherein the upper front flap of the container includes a forward section cut away from remaining sections of the upper front flap having the front flap aperture, the remaining sections of the upper front flap positionable behind the lower front flap when the container is closed, and the forward section of the upper front flap positionable in front of the lower front flap when the container is closed, whereby when the tapered front end is forced through the front flap apertures of the container when the container is closed, the at least one resilient flange flexes to fit through the front flap apertures, thereafter springing back to the natural position such that when the body is pulled away from the container back through the front flap apertures the distal end of the at least one flange contacts the front flap of the container to inhibit the removal thereof from the container, and whereby the lower front flap reinforces the forward section of the upper front flap when the front end of the elongated body is pushed through the front flap apertures to lock the container.

6. The system of claim 5 wherein the at least one angled resilient flange is exactly two angled resilient flanges, one on each side of the elongated body, together with the body forming an arrow shape.

7. The system of claim 5 wherein the rear end of the elongated body includes a grip-facilitating structure in the form of a bulbous end.

8. The system of claim 5 wherein the transverse stop comprises exactly two transverse legs, each projecting away from the elongated body in opposing directions.

9. The system of claim 5 wherein the elongated body and the at least one resilient flange are integrally formed.

10. The system of claim 9 wherein the elongated body and the at least one resilient flange have a consistent cross-section from a top side thereof to a bottom side thereof, whereby the elongated body and the at least one resilient flange are formed through an extrusion process.

11. The system of claim 5 wherein the container includes a perforated punch-out section affixed with the forward section of the upper flap, wherein when the elongated body is engaged with the front flap aperture to lock the container in the closed position, to unlock the container a user depresses the punch-out tab downward to release the punch-out tab and the forward section from the container to unlock the container.

* * * * *